United States Patent [19]

Mullet

[11] Patent Number: 4,779,325

[45] Date of Patent: Oct. 25, 1988

[54] METHOD OF MAKING AN OVERHEAD DOOR PANEL

[76] Inventor: Willis Mullet, 3341 Edgewater Dr., Gulf Breeze, Fla. 32561

[21] Appl. No.: 82,439

[22] Filed: Aug. 6, 1987

Related U.S. Application Data

[62] Division of Ser. No. 798,966, Nov. 18, 1985, Pat. No. 4,685,266.

[51] Int. Cl.[4] ..... B21D 39/00

[52] U.S. Cl. ..... 29/460; 29/525.1

[58] Field of Search ..... 29/460, 526 R; 52/309.11, 802, 813; 160/232

[56] References Cited

U.S. PATENT DOCUMENTS

| | | | |
|---|---|---|---|
| 2,209,070 | 7/1940 | Bridgman | 29/526 X |
| 3,479,784 | 11/1969 | Massagli | 52/309.11 X |
| 3,612,582 | 10/1971 | Pitner | 29/526 X |
| 3,740,916 | 6/1973 | Kenaga | 52/814 |
| 3,967,671 | 7/1976 | Stanley et al. | 160/232 |
| 4,132,042 | 1/1979 | DiMaio | 52/309.1 |
| 4,284,119 | 8/1981 | Martin | 160/232 |
| 4,339,487 | 7/1982 | Mullet | 428/71 |
| 4,379,480 | 4/1983 | Kempel et al. | 160/232 |
| 4,583,796 | 4/1986 | Nakajimi et al. | 52/802 X |

FOREIGN PATENT DOCUMENTS

| | | | |
|---|---|---|---|
| 586853 | 12/1958 | Italy | 52/802 |
| 642228 | 6/1982 | Italy | 160/232 |
| 206540 | 12/1965 | Sweden | 52/802 |
| 1586755 | 3/1981 | United Kingdom | 52/309.11 |

*Primary Examiner*—P. W. Echols
*Assistant Examiner*—Andrew E. Rawlins
*Attorney, Agent, or Firm*—Renner, Kenner, Greive, Bobak, Taylor & Weber

[57] ABSTRACT

An overhead garage door panel (9) having a front sheet metal skin (10) and a rear skin (11) of insulating material and a core (12) of synthetic foam between the skins, the marginal edges of said metal skin (10) being progressively formed into folded over hems (24) of double thickness, said hems (24) then being further progressively roll-formed into rearwardly disposed upwardly offset upper and lower channels (20) and (20') extending longitudinally of said panel (9), and applying vertical metal end stiles (13) to the ends of said channels (20) and (20') to enclose the ends of said core (12).

4 Claims, 3 Drawing Sheets

FIG. 5
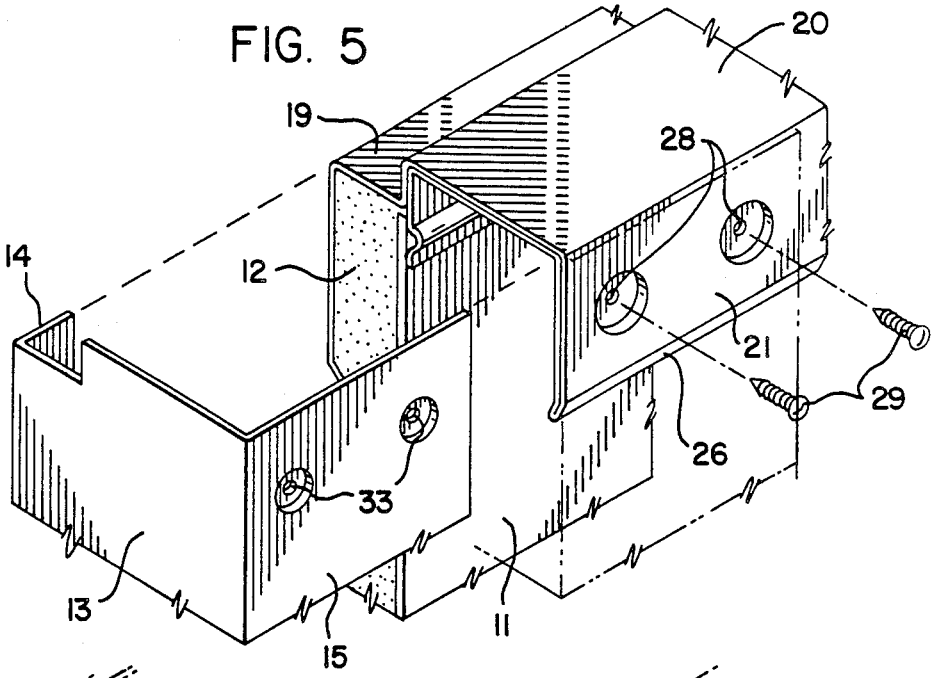
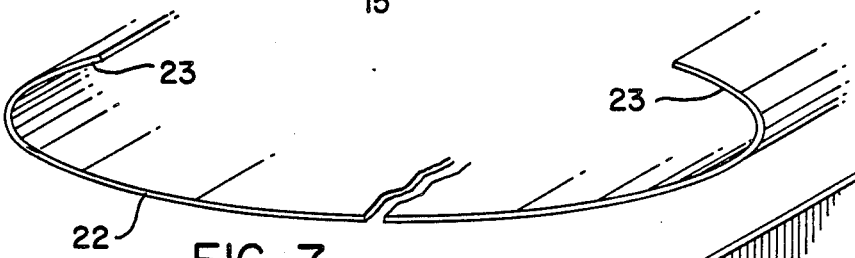
FIG. 7
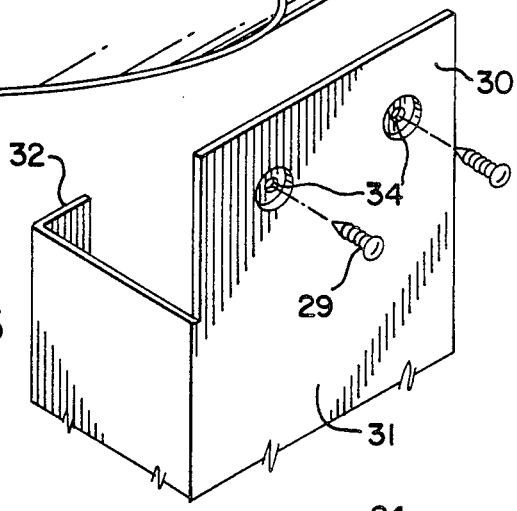
FIG. 6
FIG. 8
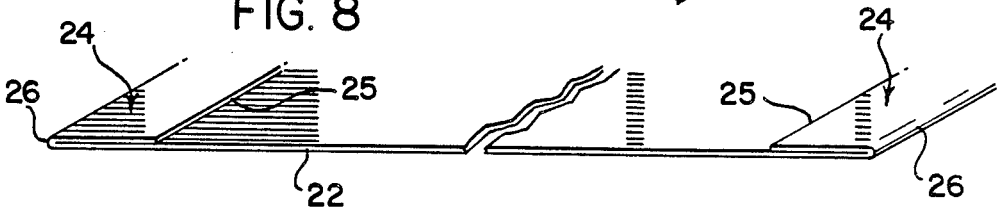

METHOD OF MAKING AN OVERHEAD DOOR PANEL

This application is a division of application Ser. No. 798,966, filed Nov. 18, 1985, U.S. Pat. No. 4,685,266, issued Aug. 11, 1987.

TECHNICAL FIELD

The invention relates to panel sections forming parts of an overhead garage door and the like having an improved construction comprising a synthetic foam core and a metallic outer skin.

BACKGROUND OF THE INVENTION

Conventional overhead garage doors have panels or sections which for many years were predominantly of wood construction. Recently, the trend has been to doors with panels comprising a synthetic foam core encased in a weather-resistant outer skin of metal. Such doors were normally somewhat more expensive than wood doors but tend to be no more noisy in operation than wood doors. Moreover, the synthetic foam core is desirable to provide increased thermal insulation.

Certain prior doors of this type, as shown for example in U.S. Pat. No. 4,339,487, were provided with longitudinal ribs in the metallic skin in order to minimize waviness of distortion which tends to occur in the metal, especially as a result of stretching the metal when roll-forming the edges or shiplaps. However, the longitudinal ribs added weight and expense and imparted an unattractive appearance, making such constructions unsuitable for residential overhead garage doors.

The smaller lighter weight residential garage doors have been made of composite steel skin and synthetic foam core without the longitudinal stiffening ribs, thereby producing a door of excellent thermal insulation properties and relatively quiet operation. However, such doors have been more expensive and heavier and less attractive than wood doors.

DISCLOSURE OF THE INVENTION

It is an object of the present invention to provide an improved overhead garage door construction especially adapted for residential use.

Another object is to provide an improved garage door which will cost no more to produce than a conventional wood door of the same size.

A further object is to provide an improved composite door construction that operates as quietly as a wood door of comparable size.

Another object is to provide an improved construction having an outer metallic surface adapted to be embossed to enhance its appearance.

A still further object is to provide an improved door construction of improved thermal insulation properties as compared to wood doors.

Still another object is to provide an improved metal-skin foam-core door construction in which the metal skin has hem portions of double thickness along both end edges of the door panel, thus providing minimal weight without sacrificing strength.

These and other objects are accomplished by the present improved door construction, a preferred embodiment of which is disclosed herein as illustrating the best known mode of carrying out the invention. Various changes in details of construction and modifications of the improved construction are comprehended within the scope of the appended claims.

BRIEF DESCRIPTION OF THE DRAWINGS

FIG. 5 is an enlarged exploded fragmentary perspective view showing the upper corner as seen in FIG. 2.

FIG. 6 is a detached, enlarged fragmentary perspective view of the upper end of a vertical reinforcement strut as seen in FIG. 2.

FIG. 7 is a detached end view of the metal skin of the door panel during an intermediate forming step.

FIG. 8 is a detached end view thereof during a subsequent step forming longitudinal folded over hems in the metal skin.

DESCRIPTION OF A PREFERRED EMBODIMENT

Figure 1:
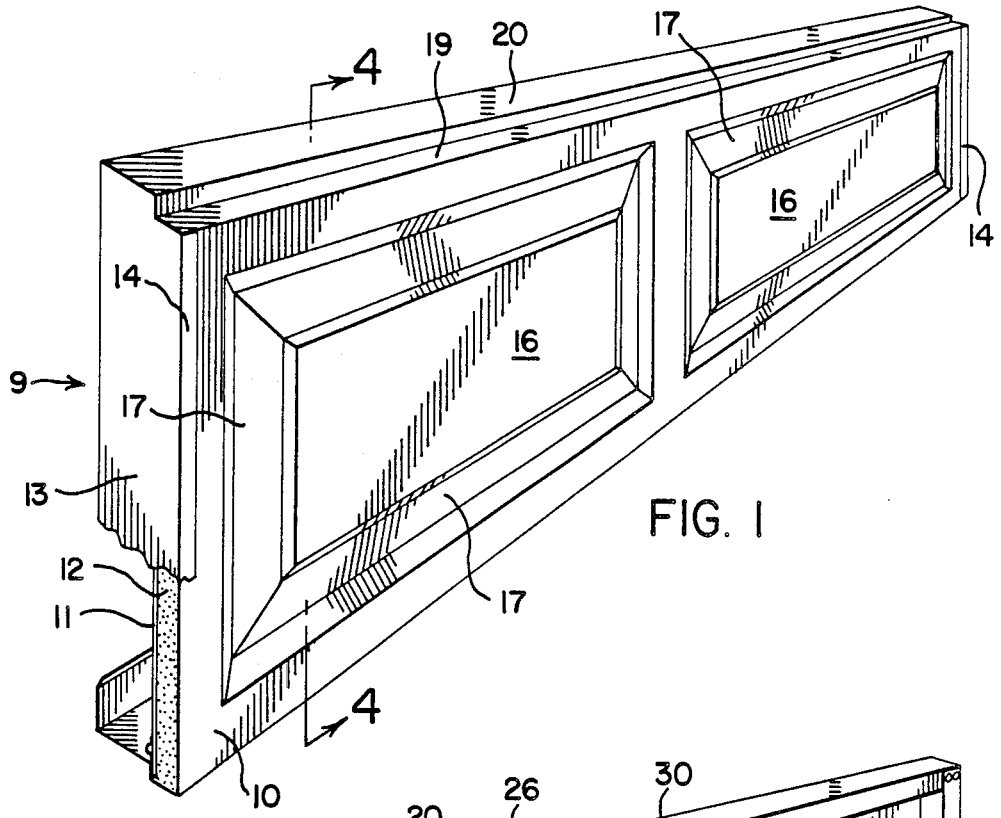
FIG. 1 is a front perspective view of a preferred embodiment of the improved door panel constituting the invention.

As shown in FIGS. 1–4 of the drawings, the improved door panel, indicated generally at 9, has an embossed outer sheet metal skin 10, and a flat inner skin of insulating material, which may be Kraft paper backed by metal foil, indicated generally at 11. The two skins extend continuously the full length of the panel and enclose a core of insulating material indicated at 12 which may be synthetic resin such as polyurethane foam. Preferably the foam is backed by a metal foil. The ends of the panel are enclosed by wraparound metal channel stile members 13 which have front vertical flanges 14 overlying the front lateral edges of the metal skin and inturned rear vertical flanges 15.

The metal skin 10 preferably has longitudinally spaced flat rectangular embossments 16 formed by peripheral embossments 17. Two such embossments are shown but this number may be varied depending upon the width of the door.

The metal skin 10 has top and bottom horizontal rearwardly disposed flanges 19 and 19', respectively. An upwardly offset downwardly open channel 20 of double thickness extends rearwardly from flange 19 terminating in a downturned rear flange 21, and an upwardly offset upwardly open channel 20' of double thickness extends rearwardly from flange 19' terminating in an upturned rear flange 21'. It will be seen that the top of each door panel 9 will form a shiplag joint with the bottom of a like panel when the panels are hinged together to form a sectional door rolling on a track to an overhead position in a well-known manner when the door is opened, and to a selective position closing the doorway.

The embossments 16, 17 are progressively formed in the metal skin 10 and the channels 20 and 21 of double thickness are then formed by progressively roll-forming a sheet blank 22 which becomes the metal skin 9, first with inwardly curved edges 23 as shown in FIG. 7, and then gradually roll-forming the curved edges 23 into folded-over marginal hems 24 having inner edges 25 and outer edges 26 as shown in FIG. 8. The hems 24 are then continuously and progressively roll-formed into the offset channels 20 and 20' in which the edges 26 become the folded ends of flanges 21 and 21'. Single-ply marginal portions 27 of the inner edges 25 of the hems are projected beyond the flanges 19 and 19' to form supports for the top and bottom edges of the inner skin 11.

Next, the polyurethane core is continuously laid and cured onto the metal skin 10, and the inner skin 11 later applied by forming a longitudinal bead 25' in each flange 27 for the reception of adhesive to attach the upper and lower marginal edges of the skin 11 thereto.

Figure 2:
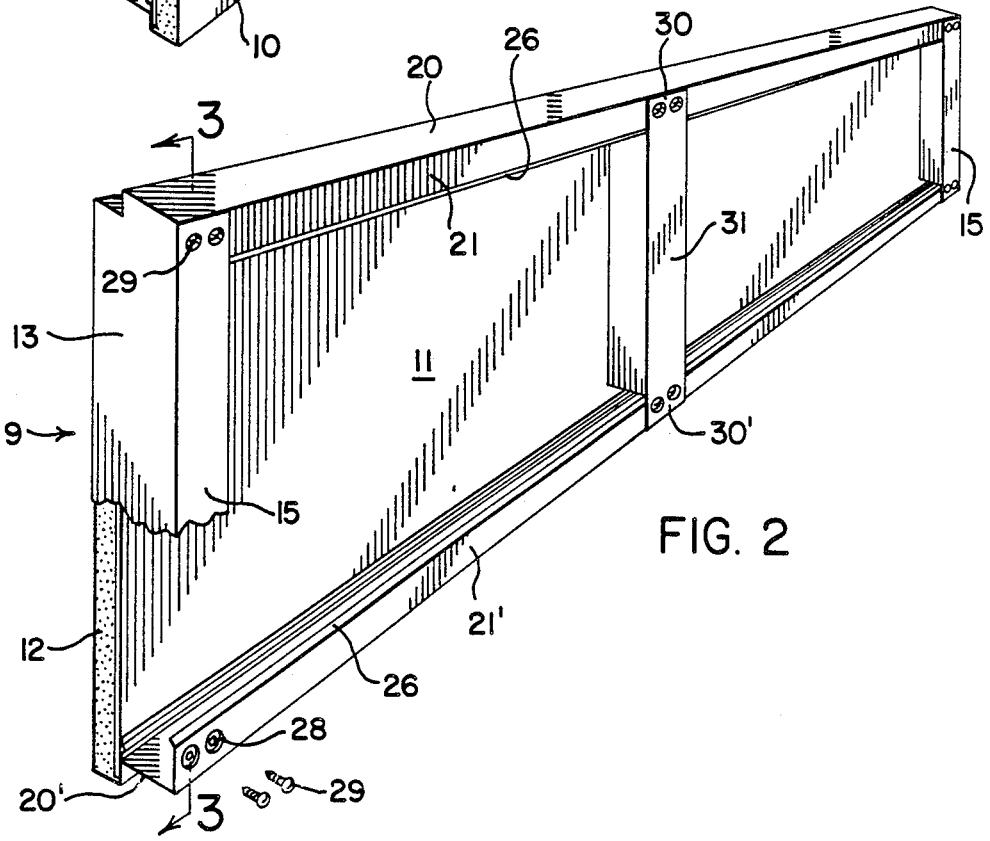
FIG. 2 is a rear perspective view thereof.
Figure 3:
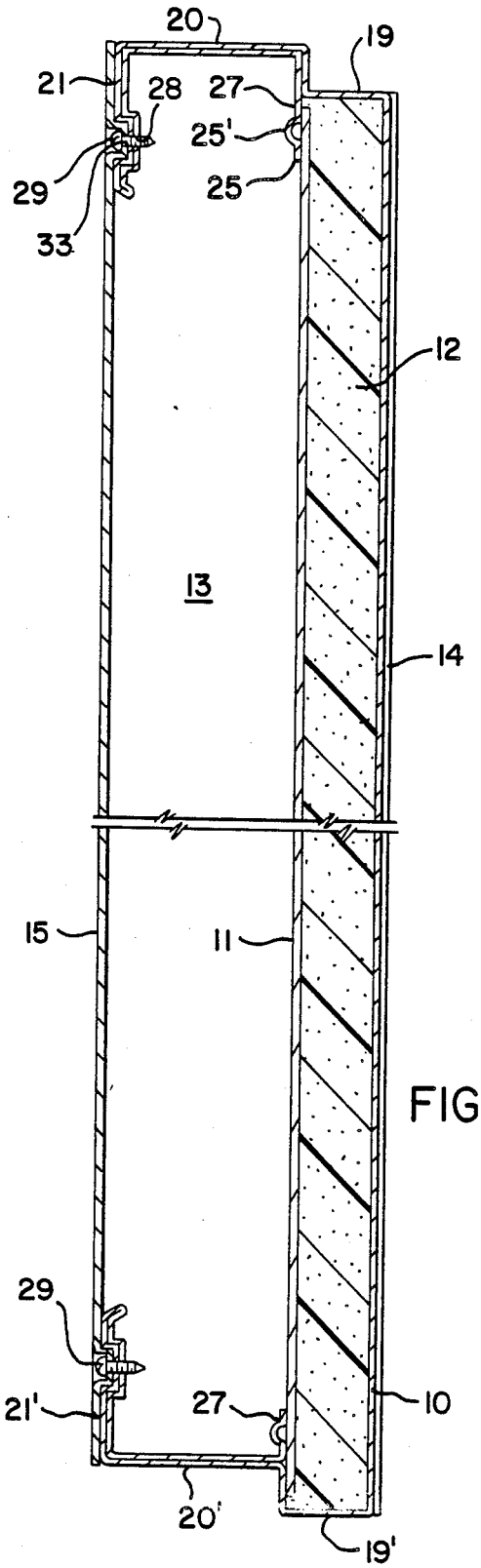
FIG. 3 is an enlarged cross-sectional view on line 3—3 of FIG. 2.
Figure 4:
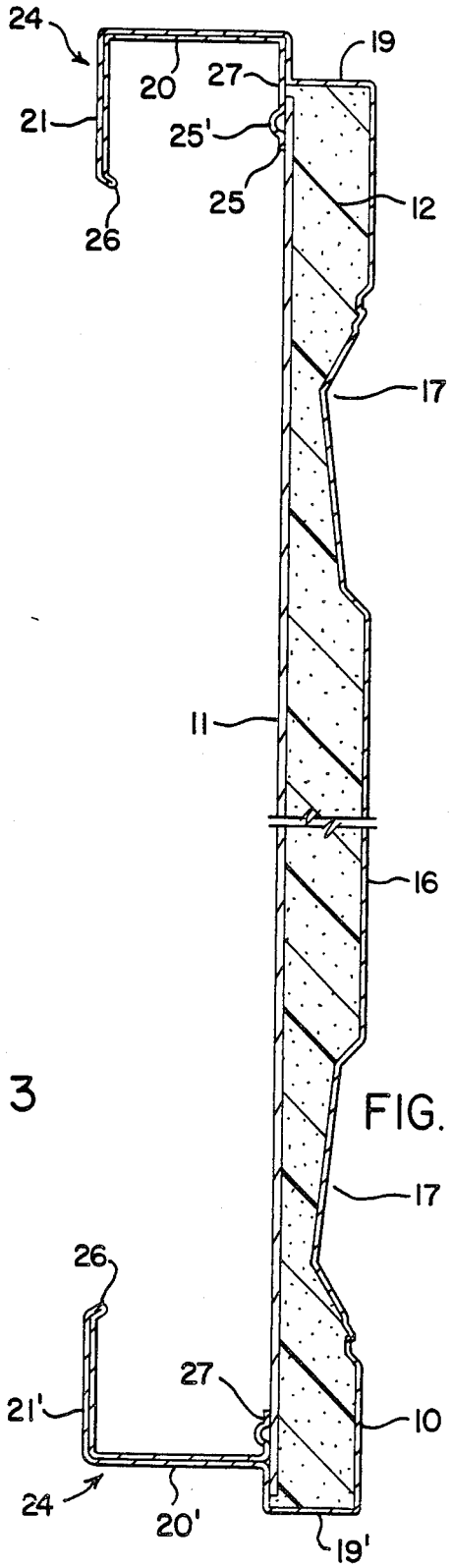
FIG. 4 is an enlarged cross-sectional view on line 4—4 of FIG. 1.

As shown in FIGS. 2, 3 and 5, the rear flanges 21 and 21' are provided at their ends and at intermediate positions with holes 28 to fasten with screws 29 the overlying perforated flanges 15 of the end stile members 13, and the overlying top and bottom flanges 30 and 30' of intermediate stile members 31. While only one intermediate stile member is shown it will be obvious that additional intermediate stile members may be desired if the door panel is elongated for use in wider door openings.

To complete the assembly the end stiles 13 are attached by laying a continuous bead of adhesive on the inside surfaces of the flanges 14 of the end stiles 13, and then snapping them over the opposite ends of the enclosed core 12, whereupon the screw holes 33 in flanges 15 of the stiles will register with holes 28 in rear flanges or legs 21 and 21' of channels 20 and 20', for receiving attaching screws 29. Similarly, one or more intermediate stiles 31 are attached by laying a continuous bead of adhesive along flange 32 to adhere to the top and bottom edges of skin 11, and inserting screws 29 in the holes 34 registering with holes 28 in flanges 21 and 21'.

The continuous poured polyurethane core 12 provides an insulating thermal break in the improved door panel 9, and also provides structural strength to the outer steel skin 10, resulting in quiet operation. The structural strength is enhanced by the double thick longitudinal channels formed in hems 24 so that the base of sheet metal skin 10 can be of minimal single thickness resulting in minimal overall weight with adequate strength, providing a door which operates quietly and easily and has greater thermal insulation than a wood door. The thickness of the metal skin 10 is actually less than half that used in conventional steel residential doors. The double-thick longitudinal channels 20 and 20'; which serve as shiplap joints, absorb most of the stresses applied to the face of the door, as well as downward stresses applied when the door is in overhead position. As a result, the longitudinal channels 20 and 20' keep the deflection of the improved door panel 9 well within the designated National Garage Door Manufacturers standard of one inch of deflection per 120 inches of length for doors in the overhead position.

The present improved door meets and exceed this standard without additional externally fastened struts or stiffness which are required on most conventional 16 foot wide doors in order to meet the standard minimum deflection standard.

I claim:

1. The method of making an overhead garage door panel comprising the steps of:

continuously and progressively roll-forming the marginal edges of a sheet metal blank comprising the front skin of said panel into first and second opposed fold-over hems of double thickness, each said hem having an inner and an outer edge;

continuously and progressively forming upper and lower rearwardly disposed flanges essentially perpendicular to said front skin;

continuously and progressively roll-forming said first and second hems into rearwardly disposed upper and lower longitudinally extending channels of double thickness, upwardly offset from said upper and lower flanges, said first hem forming a downturned rear flange terminated by said outer edge, said second hem forming an upturned rear flange terminated by said outer edge;

continuously and progressively forming first and second single-ply marginal portions of said first and second hems between said downturned and upturned rear flanges and said front skin and terminated by said inner edges, continuously and progressively laying and curing a core of synthetic foam on said metal skin and between said upper and lower rearwardly disposed flanges;

providing a longitudinal bead in each said single-ply marginal portion;

applying an adhesive to said longitudinal beads and adhering an inner skin of insulating material between said first and second single-ply marginal portions of said hems and said metal skin to enclose said core.

2. The method of claim 1, including the step of applying metal end stiles to the ends of said panel to enclose said core.

3. The method of claim 2, including the step of providing said stiles with flanges and then securing said flanges to said downturned and upturned rear flanges.

4. The method of claim 3, including the step of securing at least one intermediate stile to said downturned and upturned rear flanges.

* * * * *